US006402413B1

(12) United States Patent
Schwartzman

(10) Patent No.: US 6,402,413 B1
(45) Date of Patent: Jun. 11, 2002

(54) LIQUID APPLICATOR VALVE

(76) Inventor: Gilbert Schwartzman, 1025 Old White Plains Rd., Mamaroneck, NY (US) 10543

( * ) Notice: Subject to any disclaimer, the term of this patent is extended or adjusted under 35 U.S.C. 154(b) by 0 days.

(21) Appl. No.: 09/793,680

(22) Filed: Feb. 27, 2001

(51) Int. Cl.[7] ..... B05C 17/00
(52) U.S. Cl. ..... 401/264; 401/206; 401/273
(58) Field of Search ..... 401/206, 264, 401/273; 222/213

(56) References Cited

U.S. PATENT DOCUMENTS

| | | | | |
|---|---|---|---|---|
| 775,411 A | | 11/1904 | Wheeler | |
| 2,681,752 A | | 6/1954 | Jarrett et al. | |
| 2,996,750 A | | 8/1961 | Cholet | |
| 3,129,452 A | * | 4/1964 | Schwartzman | 401/206 |
| 3,242,928 A | | 3/1966 | Peters | |
| 3,400,997 A | | 9/1968 | Schwartzman | |
| 3,606,088 A | | 9/1971 | Baltzer | |
| 3,640,631 A | | 2/1972 | Sotir | |
| 3,661,468 A | | 5/1972 | Schwartzman | |
| 4,693,623 A | * | 9/1987 | Schwartzman | 401/206 |
| 4,993,859 A | | 2/1991 | Assad et al. | |
| 5,120,148 A | * | 6/1992 | Waters et al. | 401/264 |
| 5,299,877 A | | 4/1994 | Birden | |

* cited by examiner

*Primary Examiner*—Timothy L. Maust
*Assistant Examiner*—Peter deVore
(74) *Attorney, Agent, or Firm*—Clyde I. Coughenour

(57) ABSTRACT

A fluid applicator includes a coating implement, a resilient closure cap, and a stopper for use with a fluid container. The resilient closure cap is force-fit into or onto the stopper, creating a resilient force on a sealing lip that contacts a seat on the stopper. Inverting the container and pressing on the coating implement, presses the resilient closure cap, deforming it to move the sealing lip off of its seat on the stopper, to allow fluid flow from the container, through the stopper and resilient closure cap, to the coating implement.

20 Claims, 2 Drawing Sheets

LIQUID APPLICATOR VALVE

BACKGROUND OF THE INVENTION

1. Field of the Invention

A liquid valve body for attachment with the neck of a liquid container has liquid dispensed by inverting the container and pressing on an implement that in turn presses on an elastic closure cap having a valve seal that is lifted off of its seat on a stopper to pass liquid therethrough.

2. Description of Related Art

The dispensing of fluids by application of pressure against the coating or writing implement is common in the art. G. Schwartzman, U.S. Pat. No. 3,400,997, issued Sep. 10, 1968 and P. Sotir, U.S. Pat. No. 3,640,631, issued Feb. 8, 1972, are examples of pressure applied to an implement to press the implement inwardly to lift a valve off of its seat to open a passage for the flow of fluid to the implement. B. Cholet, U.S. Pat. No. 2,996,750, issued Aug. 22, 1961, and W. Baltzer, U.S. Pat. No. 3,606,088, issued Sep. 20, 1971, are examples of integral discharge implement holders and resilient or elastic force applying means. Jarrett et al, U.S. Pat. No. 2,681,752, issued Jun. 22, 1954, and G. Schwartzman, U.S. Pat. No. 3,661,468, issued May 9, 1972, are examples of cap or dome-shaped resilient means for pressure application in fluid dispensing devices.

SUMMARY OF THE INVENTION

The invention is to an instrument for the application of a fluid for writing or coating by dispensing fluid from a container. The instrument consists of three major components: a stopper, a resilient closure cap and a nib or other coating implement. The resilient closure cap is one integral piece that can essentially be considered to include a pocket for holding a nib or other implement, a diaphragm and an elastic dome that acts as a spring, and a valve neck with a sealing rib that engages with a valve seat on the stopper to form a fluid flow control.

The resilient closure cap is attached to, or inserted into an annular recess in, the stopper so that a force is created on the dome area of the resilient closure cap pressing the sealing rib against the stopper valve seat precluding fluid flow through the instrument or pressing the sealing rib away from the valve seat. Fluid is dispensed by pressing against the nib or other implement that in turn presses against the valve neck and lifts the sealing rib off of the valve seat to provide a flow path between the fluid container and the nib.

DESCRIPTION OF THE PREFERRED EMBODIMENTS

Figure 1:
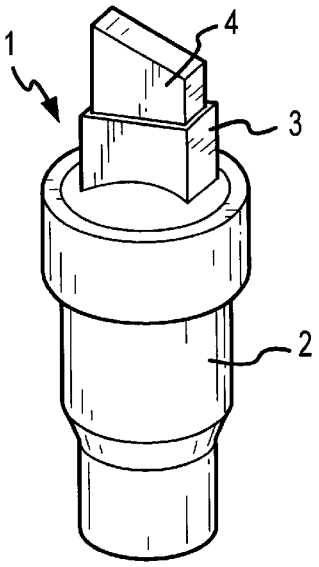
FIG. 1 is a perspective view of the applicator valve of the invention.

The invention is to an applicator 1 consisting of three major components shown in FIG. 1 as a stopper 2, a resilient closure cap 3, and a nib 4 that attach to a fluid container 6.

The stopper 2 fits within or over the container neck to act as a seal against unwanted fluid discharge and as a controlled passage for fluid discharge. The stopper 2 supports the resilient closure cap 3 and the closure cap 3 secures the nib or other implement 4 in place. Pressure on the nib opens a fluid flow passage so that the fluid can pass from the fluid container to the nib for application to an object.

Figure 2:
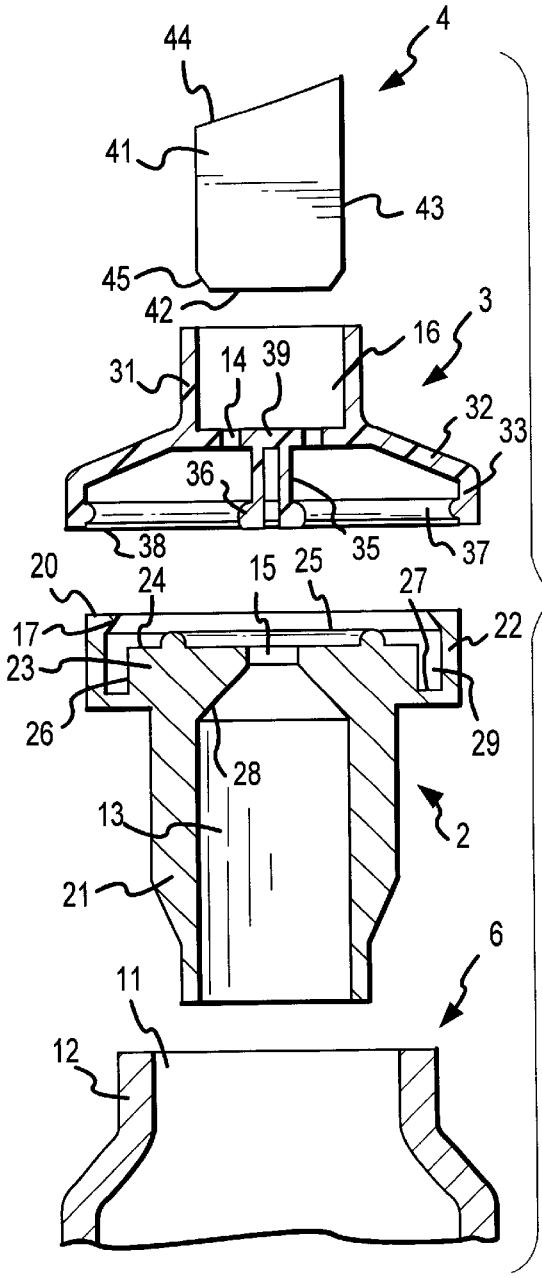
FIG. 2 is an exploded view of the component parts of the applicator valve.

The individual components are best seen in FIG. 2. The stopper 2 second or lower end as shown is designed to fit within the upper neck 12 of a fluid container 6 by inserting the stopper lower neck 21 into the container neck or opening 11. The stopper 2 second or lower end could be designed to fit over the container neck or both over and within the container neck if desired.

The first upper end 20 of the stopper 2 has a raised upwardly extending interior section 23 formed about a central opening 15. The inner upper wall of the stopper neck 21 is sloped inwardly forming a tapered valve seat 28 that ends or terminates in the central opening or fluid passage 15. This forms a valve seat under, around, and adjacent to the fluid passage. The upper first end 24 of the interior section 23 is provided with a raised circular limit rib 25. The outer wall of the interior section forms a sealing rim 26 that terminates at its lower end in a recessed base 27. Extending essentially parallel to and outwardly from the sealing rim 26 is an outer circumferential side wall 22 of the stopper that terminates, slightly above the circular limit rib 25, with an inwardly extending side wall lip 17.

The resilient closure cap 3 has an integral central diaphragm area 39 extending outwardly into a dome-shaped intermediate area section 32 with a skirt area 33 extending downwardly from the lower radial extremity of the dome area 32 forming a first end. A flexible implement mounting sleeve 31 extends upwardly from the dome upper area extremity forming a second end having an implement receiving pocket 16. The diaphragm area 39 is provided with slot openings 14 inwardly of and adjacent to the mounting sleeve 31. About the center of the diaphragm area, a valve neck 35 extends downwardly from the diaphragm. At the lower end of the valve neck, a circular sealing lip 36 extends outwardly. The valve neck 35 is preferably hollow to reduce rigidity. The inner lower first end of the skirt area 33 is provided with a sealing rib 37.

The resilient closure cap 3 can be made from an elastic resilient stretchable material such as a plastic or natural or synthetic rubber material having the necessary elasticity or resilience to flex or extend for insertion into or over the stopper 2, and to deform or stretch enough for sealing and valve operation, and to hold the implement. The material must be compatible with the fluid used. The diaphragm slot opening 14 performs two functions, it weakens the resistance to deformation of the central area of the diaphragm 39 and it provides a passage for the fluid moving past the sealing lip 36 when the valve neck is pressed inwardly.

As the coating or writing implement, a nib 4 is shown. The nib arbitrarily has a rectangular cross-section, but could be any type implement in any shape. The nib as shown has side surfaces 41, end surfaces 43, top coating or writing surfaces 44 and a fluid accessible and receptive bottom or lower surface 42. The nib can be felt, passaged plastic, or open-cell foam material compatible with the fluid used. One example of the material that can be used is a rigid open pore nib as set forth in U.S. Pat. No. 5,299,877, issued Apr. 5, 1994 to D. Birden. By using this material, a liquid containing particles can be passed through the applicator.

The components are assembled by placing the stopper 2 neck 21 within the fluid container 6, neck 12. The resilient closure cap 3 skirt 33 has a slightly larger diameter than that of the circumferential side wall 22 inside diameter, and the valve neck 35 has a smaller outside diameter than that of the diameter of the fluid passage 15. The outside diameter of the sealing lip 36 is larger than that of the fluid passage. The skirt area 33 can be pressed into the circumferential recess 29, as the sealing lip 36 is pressed through the fluid passage 15, until the resilient cap base or first end 38 abuts or essentially abuts the recess base 27. Pressing the resilient closure cap skirt 33 into the circumferential recess 29 between the circumferential side wall 22 and sealing rim 26 places the dome area 32 under compression, tending to press or deform the attached diaphragm dome primarily upwardly. This upward movement of the dome area places an upward tension force on the central area of the diaphragm 39 and valve neck 35, attached to the diaphragm, and on the sealing lip 36 on the valve neck. This can be seen in FIG. 3, where the dome 32 of the resilient closure cap 3 is deformed upwardly by pressing the slightly oversize skirt into the circumferential recess 29 of the stopper. This deformation or upward force causes a spring-like force on the valve neck 35 and sealing lip 36, preventing fluid flow by engaging the sealing lip with the stopper valve seat 28.

Figure 3:
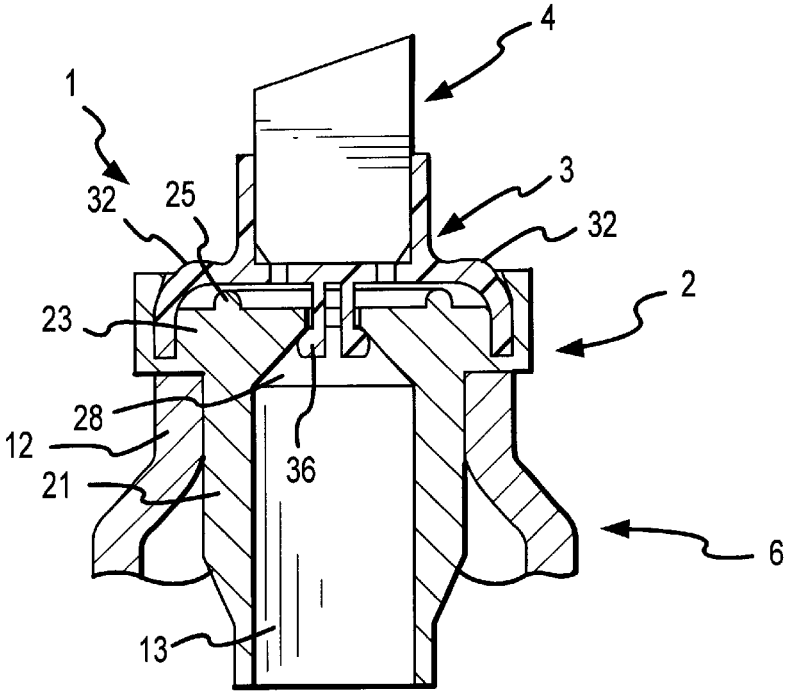
FIG. 3 is a sectional view of the application valve in its non-use configuration.

In this position, shown in FIG. 3, the circular sealing rib 37 engages the sealing rim 26 to form a fluid-tight seal between the cap skirt area 33 and stopper sealing rim 26, as the sealing lip 36 engages the tapered valve seat 28, to form a fluid-tight seal between the stopper 2 inner surface 28 and the resilient closure cap 3 sealing lip 36. The sealing rib 37 is not visible in FIGS. 3 and 4 because it is essentially flattened due to pressure placed on it during insertion.

The writing or coating implement 4 is preferably slightly larger than the implement pocket 16 to provide a resilient force fit. The implement 4 is pressed into the implement pocket 16 until the implement base or back surface 42 abuts against the resilient cap diaphragm 39. The lower or bottom surface 42 can be provided with a taper or chamfer 45 for concentrating pressure on the central portion of the diaphragm 39 above the valve neck 35. This taper or chamfer, depending on its size, can provide a liquid path around the base of the nib, or can cover the slot openings 14 for direct access of fluid to the nib base. The design depends on the type fluid being used and the type nib being used as well as the force necessary to press the diaphragm central area inwardly.

Figure 4:
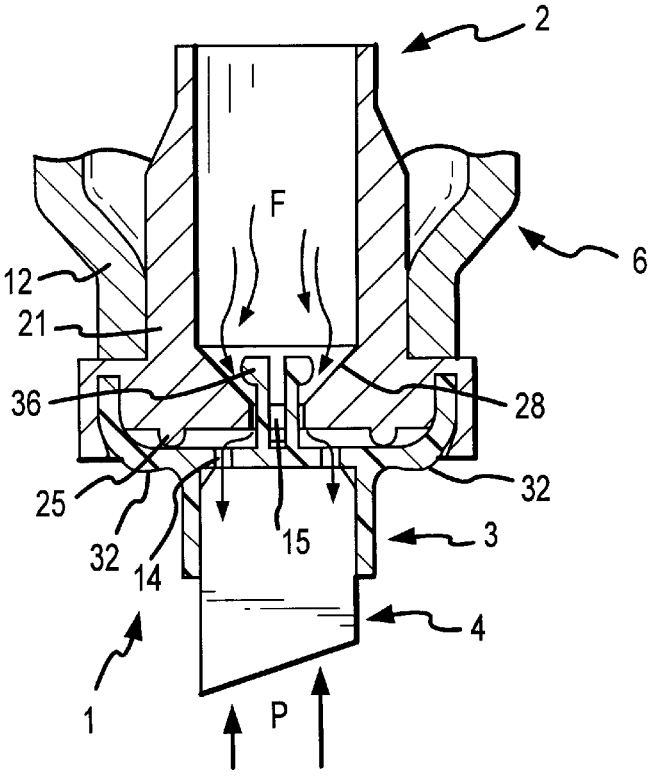
FIG. 4 is a sectional view of the applicator valve in its in-use configuration.

During non-use, the fluid within the fluid container 6 is sealed therein by the sealing lips 36 of the resilient closure cap 3 pressing against the tapered valve seat 28 as shown in FIG. 3. The fluid within the container can be dispensed to the implement 4 by holding the container 6 in the inverted position and pressing the implement 4 against a surface or object. As shown in FIG. 4, upward and inward pressure on the inverted implement 4 is transferred to the diaphragm area 39 where it acts against the now downward force created by the dome area 32 of the resilient cap 3. Overcoming the diaphragm resistance results in an inward movement of the valve neck 35 and sealing lip 36. The inward movement of the sealing lip causes it to separate from the tapered valve seat 28 and to open a passage from the fluid container 6 to the implement base or back 42 through the fluid passage 15 and slot openings 14. This is shown by flow arrows F in FIG. 4. The limit rib 25 of the stopper functions both as a guide for fluid flow, during fluid discharge, and to a degree as a limit stop for inward movement of the valve neck 35 and sealing lip 36. The limit rib 25 helps prevent the slots 14 of the resilient closure cap from being blocked by the upper end 24 of the interior section 23 during pressure application against the nib 4. This can be seen in FIG. 4 when pressure P on the nib 4 overcomes the force created by the dome 32 of the resilient closure cap, lifting the sealing lip 36 off of the valve seat 28 of the stopper 2. The limit rib 25 can have its height and position, with respect to the opening or passage 15, adjusted depending on the rigidity and elasticity of the resilient closure cap 3, the flow path desired, the viscosity of the liquid or fluid being used, the valve opening desired, etc.

Figure 5:
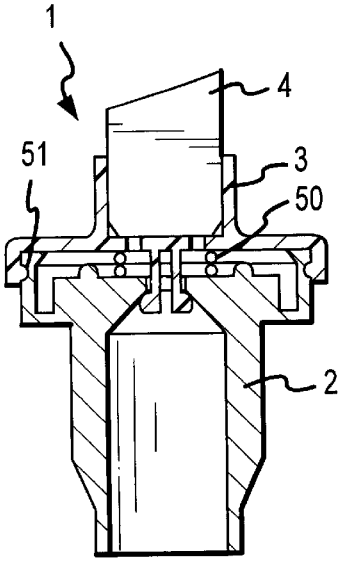
FIG. 5 is a sectional view of a modification of the applicator valve.

A modification of assembly and use is shown in FIG. 5. Rather than forcing the skirt 33 into the circumferential recess 29, as shown in FIGS. 3 and 4, the skirt is stretched over the outer circumference of the upper first end of the stopper 2. This places the dome area and diaphragm area under tension. With the skirt and dome under tension, the force direction on the seating lip 36 will depend on the relative length of the valve neck 35. A short neck will be pulled upward by the tension on the diaphragm area and close off flow by engaging the sealing lip 36 with the valve seat 28. A long neck will extend beyond the effective range of the tension on the diaphragm. With a long neck, the tension will tend to keep the sealing lip below and off of the valve seat, and a spring or other means is required to raise the diaphragm to engage the sealing lip with the valve seal. A spring 50 can be placed between the diaphragm 39 and the stopper upper surface 24. This spring can be used to increase the force placed on the sealing rib or to cause the sealing rib to engage the valve seat. To assist placement or to secure the skirt onto the stopper circumference, a groove 51 can be placed around the stopper upper circumference 22 near the stopper first upper end 20 to receive the sealing rib 37.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from be readily apparent to one skilled in the art and that such may be made without departing from the spirit of the invention as defined by the following claims.

What is claimed is:

1. A fluid applicator valve comprising:

a stopper and an elastic closure cap;

said stopper having a first end and a second end, a fluid passage within said first end, a vertically opening circumferential recess within said first end outward from and around said fluid passage, a valve seat under and adjacent to said fluid passage;

said elastic closure cap having a first end and a second end, a skirt area on said first end, a dome area attached to and around said skirt area, a diaphragm adjacent to and attached to said dome area on said second end central area, and a sealing lip attached to said diaphragm and extending toward said elastic closure cap first end;

said elastic closure cap skirt fitting within said stopper vertically opening circumferential recess; and, said elastic closure cap dome area and diaphragm extending over said stopper first end and said fluid passage, and said sealing lip extending under said stopper fluid passage in said stopper second end side of said fluid passage.

2. A fluid applicator valve as in claim 1 wherein:

said stopper vertically opening circumferential recess has an outside diameter that is slightly smaller than said elastic closure cap skirt outside diameter so that a compressive force is placed on said elastic closure cap dome when said skirt is inserted within said stopper vertically opening circumferential recess to place a force on said sealing lip tending to engage said elastic closure cap sealing lip with said stopper valve seat.

3. A fluid applicator valve as in claim 2 wherein:

said stopper first end has a circular limit rib for contact with said elastic closure cap to limit the distance said elastic closure cap can come to said stopper fluid passage.

4. A fluid applicator valve as in claim 2 wherein:

said stopper first end vertically opening circumferential recess is formed between a circumferential side wall and an outer sealing rim of an interior section of said stopper;

said stopper first circumferential side wall upper end has an inwardly extending side wall lip for controlling the deformation direction of said elastic closure cap dome area.

5. A fluid applicator valve as in claim 4 wherein:

said elastic closure cap skirt area first end is provided with a sealing rib on its inward lower side to preclude fluid escape from between said stopper outer sealing rim and said elastic closure cap skirt area.

6. A fluid applicator valve as in claim 1 wherein:

said elastic closure cap sealing lip is attached to said diaphragm by a valve neck, that is attached to and between said elastic closure cap diaphragm and said sealing lip;

said valve neck extends through said stopper fluid passage.

7. A fluid applicator valve as in claim 6 wherein:

said elastic closure cap valve neck has a diameter that is smaller than the diameter of said stopper fluid passage and said sealing lip outside diameter is larger than the diameter of said stopper fluid passage.

8. A fluid applicator valve as in claim 7 wherein:

said elastic closure cap second end includes a mounting sleeve with a pocket therein for reception of a coating implement.

9. A fluid applicator valve as in claim 8 wherein:

said elastic closure cap diaphragm has openings through it adjacent to said mounting sleeve for fluid flow passage into said mounting sleeve pocket.

10. A fluid applicator valve as in claim 8 wherein:

said elastic closure cap skirt, dome area, diaphragm, mounting sleeve, valve neck, and sealing lip are all formed of a one piece integral elastomeric material.

11. A fluid applicator valve as in claim 8 wherein:

said coating implement is within said elastic closure cap mounting sleeve pocket;

said elastic closure cap mounting sleeve is slightly smaller than said coating implement to form a press fit.

12. A fluid applicator valve comprising:

a stopper, an elastic closure cap and a coating tool;

said stopper having an outer circumference, a fluid passage within said circumference and a valve seat under and around said fluid passage;

said elastic closure cap consisting essentially of integral diaphragm, dome and skirt and a sealing lip, with said dome extending around and blending into said diaphragm, and said skirt extending around and blending into and downwardly from said dome, and said sealing lip extending downwardly from said diaphragm and under said stopper fluid passage;

means for applying a force on said sealing lip to press it against said stopper valve seat;

a means on said stopper for elastically securing said elastic closure cap skirt;

said means for applying a force on said sealing lip includes a difference between the circumferential length of said elastic closure cap skirt and said means for elastically securing said elastic closure cap skirt to said stopper.

13. A fluid applicator valve as in claim 12 wherein:

said means for applying a force on said sealing lip to press it against said stopper valve seat consists of:

said stopper having a circumferential recess extending round said fluid passage adjacent to said stopper outer circumference; and said elastic closure cap skirt circumference being longer than that of said stopper circumferential recess;

said force being created by pressing said elastic closure cap skirt into said stopper circumferential recess to create a compression on said elastic closure cap dome and an upward force on said elastic closure cap diaphragm to apply an outward force tending to engage said sealing lip with said stopper valve seat.

14. A fluid applicator valve as in claim 13 wherein:

said coating tool is attached to said elastic closure cap diaphragm upper surface such that inward pressure on said coating tool overcomes the outward force tending to engage said sealing lip with said stopper valve seat.

15. A fluid applicator valve as in claim 12 wherein:

said means for applying a force against said sealing lip to press it against said stopper valve seat includes a spring located between said stopper upper end, around said stopper fluid passage, and said elastic closure cap diaphragm.

16. A fluid applicator valve as in claim 15 wherein:

said elastic closure cap sealing lip is attached to said diaphragm by a valve neck that extends through said stopper fluid passage;

said valve neck is long enough to preclude contact between said sealing lip and said stopper valve seat in the absence of an outward force created by said spring.

17. A fluid applicator valve as in claim 12 wherein:

said means for applying a force against said sealing lip to press it against said stopper valve seat consists of said elastic closure cap skirt circumference being smaller than said stopper outer circumference with said elastic closure cap skirt stretched over said stopper outer circumference to place said elastic closure cap dome and diaphragm areas in tension.

18. A fluid applicator valve as in claim 17 wherein:

said elastic closure cap skirt has a sealing rib around and adjacent to its terminal lower inner end;

said stopper outer circumference has a groove extending around it;

said elastic closure cap skirt sealing rib is inserted into said stopper outer circumference groove to secure said elastic closure cap and said stopper together.

19. A fluid applicator valve as in claim 17 wherein:

said elastic closure cap sealing lip is attached to said diaphragm by a valve neck that extends through said stopper fluid passage;

said valve neck is short enough to provide contact between said sealing lip and said stopper valve seat due to the tension on said resilient closure cap diaphragm.

20. A fluid applicator valve comprising:

a stopper, an elastic closure cap and a coating tool;

said stopper having an outer circumference, a fluid passage within said circumference and a valve seat under and around said fluid passage;

said elastic closure cap consisting essentially of integral diaphragm, dome, skirt and sealing lip, with said dome extending around and blending into said diaphragm, and said skirt extending around and blending into and downwardly from said dome, and said sealing lip extending downwardly from said diaphragm and under said stopper fluid passage;

means for applying a force against said diaphragm for raising said sealing lip against said stopper valve seat;

a mounting sleeve with a pocket extending upwardly from said diaphragm;

said coating tool being secured within said mounting sleeve pocket;

slots extending through said diaphragm into said mounting sleeve pocket for fluid passage to said coating tool and for diaphragm deformation control.

* * * * *